US006929327B2

(12) United States Patent
Piretti

(10) Patent No.: US 6,929,327 B2
(45) Date of Patent: Aug. 16, 2005

(54) CHAIR WITH OSCILLATING SEAT

(75) Inventor: Giancarlo Piretti, Bologna (IT)

(73) Assignee: Pro-Cord SpA, Bologna (IT)

( * ) Notice: Subject to any disclaimer, the term of this patent is extended or adjusted under 35 U.S.C. 154(b) by 0 days.

(21) Appl. No.: 10/791,379

(22) Filed: Mar. 3, 2004

(65) Prior Publication Data

US 2004/0227385 A1 Nov. 18, 2004

(30) Foreign Application Priority Data

Mar. 4, 2003 (IT) ..... TO2003A0152

(51) Int. Cl.[7] ..... A47C 1/024

(52) U.S. Cl. ..... 297/300.2; 297/300.5; 297/302.4; 297/303.4; 297/316

(58) Field of Search ..... 297/300.2, 300.5, 297/302.4, 303.4, 316, 322

(56) References Cited

U.S. PATENT DOCUMENTS

| | | | | | |
|---|---|---|---|---|---|
| 343,626 | A | * | 6/1886 | Davis | 297/301.4 |
| 357,183 | A | * | 2/1887 | Davis | 297/301.4 |
| 2,729,273 | A | * | 1/1956 | Hamilton et al. | 248/576 |
| 4,013,257 | A | * | 3/1977 | Paquette | 248/576 |
| 5,192,114 | A | * | 3/1993 | Hollington et al. | 297/300.5 |
| 5,584,533 | A | * | 12/1996 | Schrewe | 297/300.2 |
| 5,765,914 | A | * | 6/1998 | Britain et al. | 297/300.4 |
| 6,120,096 | A | * | 9/2000 | Miotto | 297/301.4 |
| 6,213,552 | B1 | * | 4/2001 | Miotto | 297/300.5 |
| 6,382,723 | B1 | * | 5/2002 | Piretti | 297/300.1 |
| 6,572,191 | B2 | * | 6/2003 | Wild | 297/301.4 |
| 6,709,056 | B2 | * | 3/2004 | Bock | 297/300.4 |
| 2004/0155502 | A1 | * | 8/2004 | Johnson et al. | 297/300.2 |

* cited by examiner

*Primary Examiner*—Peter M. Cuomo
*Assistant Examiner*—Sarah C. Burnham
(74) *Attorney, Agent, or Firm*—Sughrue Mion, PLLC

(57) ABSTRACT

A chair, in particular an office chair, comprising: a base structure, a seat support structure, articulated to the base structure around a transverse axis, an adjustable elastic device to apply an elastic force between the base structure and the seat support structure, a manually operated adjustment device for varying the distance between said adjustable elastic device and said transverse axis.

14 Claims, 10 Drawing Sheets

12
13
16
17
18
19
20
21
22
23
IV
IV

VIII
VII
VI
IX
12
13
18
21
23
27
29
30
31
40
41
42
43
44
45
46
47
48
49
50
51
55
56
57
58
59
60
61
62
63
65
66
67
68
69
70
71
72
73
74

CHAIR WITH OSCILLATING SEAT

BACKGROUND OF THE INVENTION

The present invention relates to a chair, in particular an office chair, comprising a base structure, a seat support structure articulated to the base around a transverse axis and an adjustable elastic device to apply an elastic force between a base structure and the seat support structure.

Traditional office chairs are usually provided with a compressed spring positioned between the base structure and the seat support structure. Normally, an adjusting device is provided which allows the user to adjust the compression pre-load of the spring to vary the elastic reaction force according to his/her needs. One of the main drawbacks of traditional solutions is that said adjusting device is usually located underneath the seat, in a position that is difficult to reach by the user. Moreover, known adjusting devices require a large actuating force, which makes the adjustment operation difficult. The actuating force the user must manually apply to the adjusting device is not constant, but grows as the spring pre-load increases.

SUMMARY OF THE INVENTION

The object of the present invention is to provide an enhanced chair which allows to overcome the aforesaid drawbacks.

According to the present invention, said object is achieved by a chair having the characteristics set out in the main claim.

BRIEF DESCRIPTION OF THE DRAWINGS

An embodiment of the present invention shall now be described in detail with reference to the accompanying drawings, provided purely by way of non limiting example, in which.

DETAILED DESCRIPTION OF THE INVENTION

Figure 2:
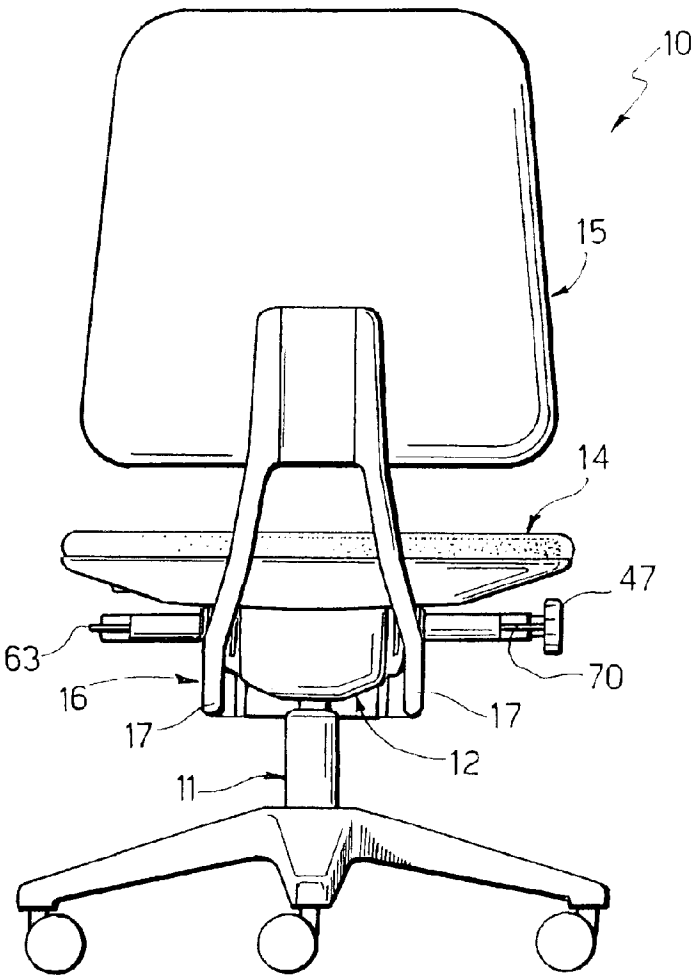
FIG. 2 is a rear view of the chair of FIG. 1.
Figure 1:
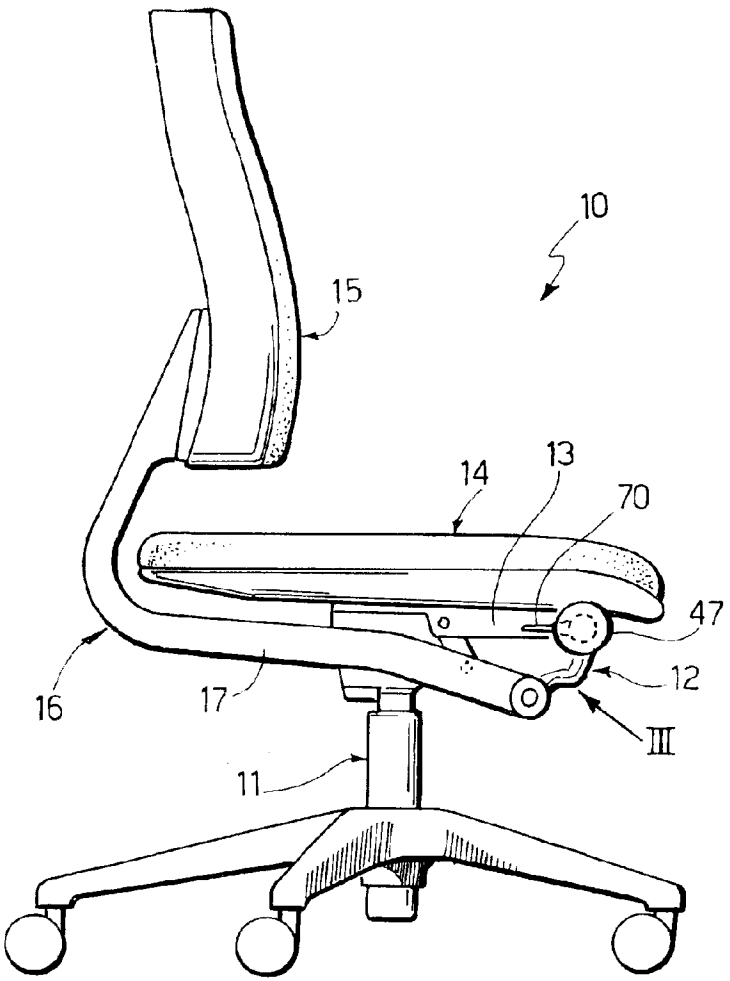
FIG. 1 is a lateral view of a chair according to the present invention.

With reference to FIGS. 1 and 2, an office chair according to the present invention is designated as 10. The chair 10 comprises a central column 11 with adjustable height which bears at its upper end a base structure 12. The base structure 12 bears a seat support structure 13 whereon is fastened a seat 14. The chair 10 comprises a backrest 15 borne by a backrest support structure 16. The backrest support structure 16 comprises two arms 17 which extend laterally and from opposite sides relative to the base structure 12.

Figures 3, 4:
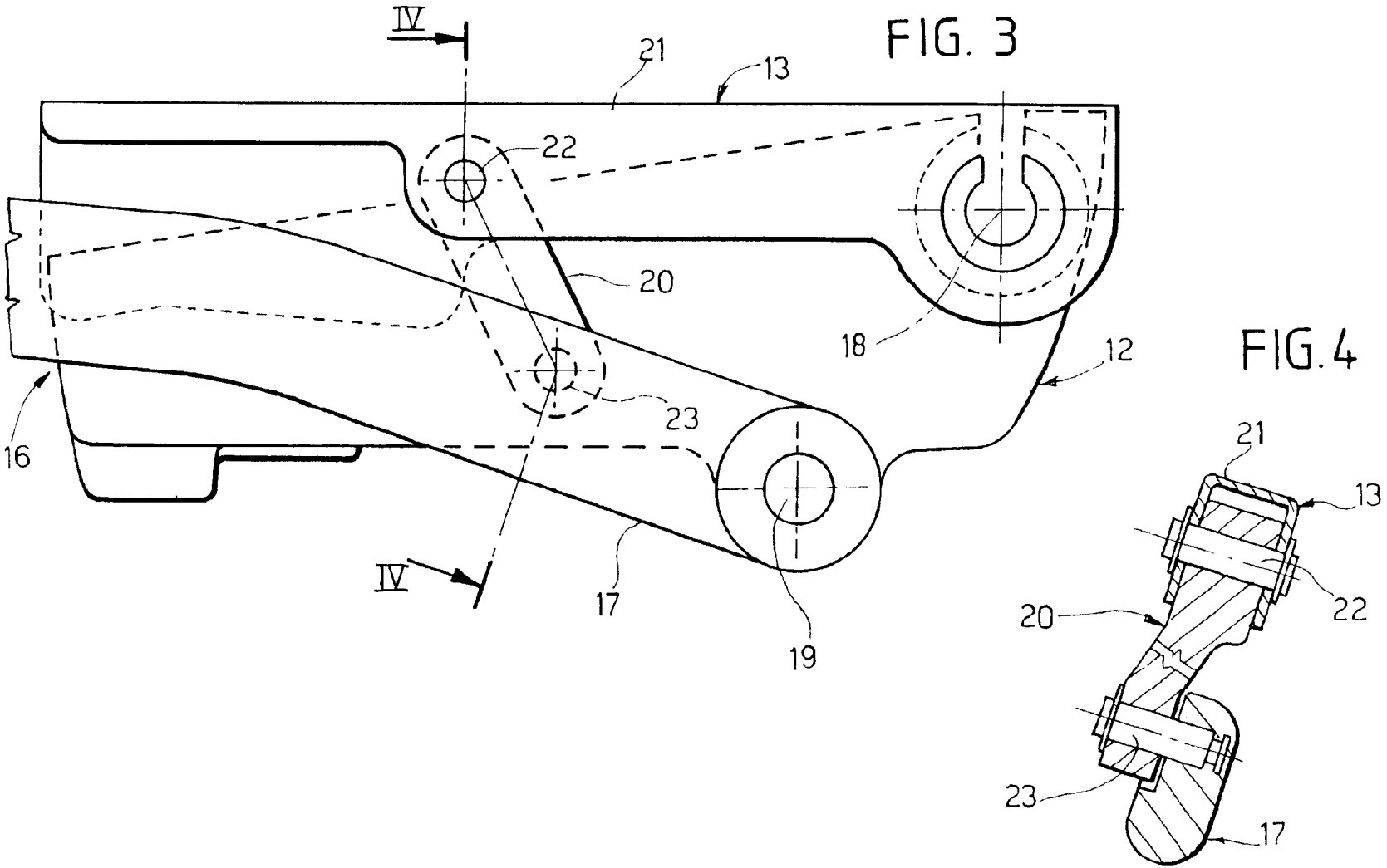
FIG. 3 is a lateral view in enlarged scale of the part designated by the arrow III in FIG. 1.
FIG. 4 is a section view according to the line IV—IV of FIG. 3.

With reference to FIG. 3, the seat support structure 13 is articulated to the base structure 12 around a first transverse axis 18 which extends orthogonally to the plane of representation of FIG. 3. The axis 18 is positioned near the front end of the base structure 12.

The arms 17 of the backrest support structure are articulated to the base structure around a second transverse axis 19, parallel to the first transverse axis 18. The second transverse axis 19 is shifted backwards and downwards with respect to the first transverse axis 18.

Each of the two arms 17 of the backrest support structure is articulated to the seat support structure 13 by means of a respective connecting rod 20. FIG. 4 illustrates the manner in which the articulated connection is obtained between the seat support structure 13 and each of the arms 17. The seat support structure 13 comprises two longitudinal elements 21 with inverted U cross section. Each connecting rod 20 has its own ends articulated respectively to the seat support structure 13 and to the backrest support structure 16. As shown in FIG. 4, each connecting rod 20 is articulated to a respective longitudinal element 21 by means of a first pivot 22 and to a respective arm 17 by means of a second pivot 23. The pivots 22, 23 define respective axes of articulation, parallel and shifted backwards relative to the axes 18, 19, with the axis of articulation positioned rearwards and upwards relative to the axis 23. This arrangement causes the oscillating motions of the seat and of the backrest to be mutually synchronised. The angles of oscillation of the seat and of the backrest are mutually correlated in such a way as to provide optimal conditions of comfort to the user in the rearwards inclined positions.

Figures 5, 6:
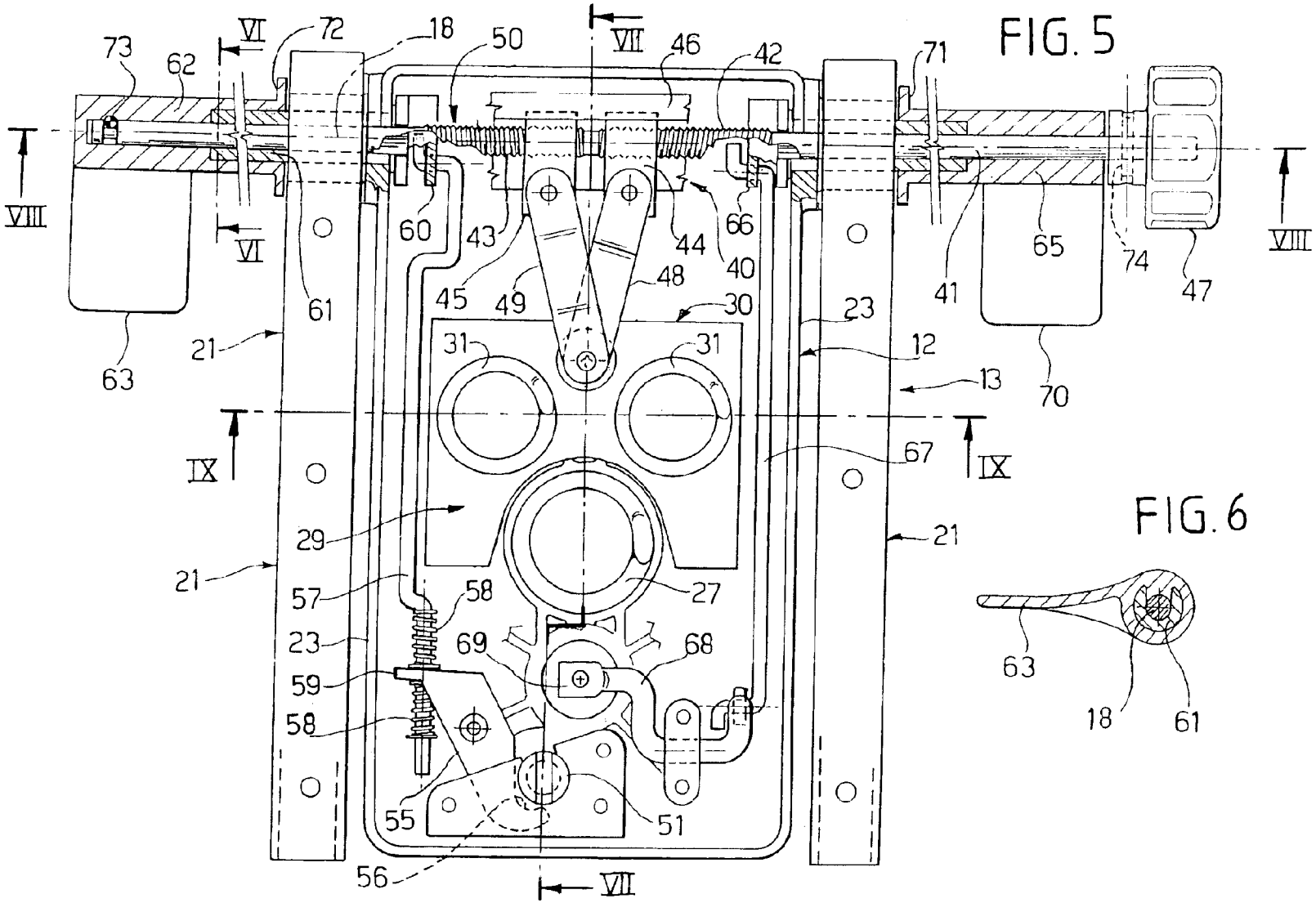
FIG. 5 is a partially sectioned view of the support and adjustment device of the chair according to the present invention.
FIGS. 6, 7, 8 and 9 are sections respectively according to the lines VI—VI, VII—VII, VIII—VIII and IX—IX of FIG. 5.

With reference to FIG. 5, the base structure 12 has, in plan view, a substantially rectangular shape. The two longitudinal elements 21 included in the seat support structure 13 extend laterally and from opposite parts with respect to the base structure 12.

Figure 8:
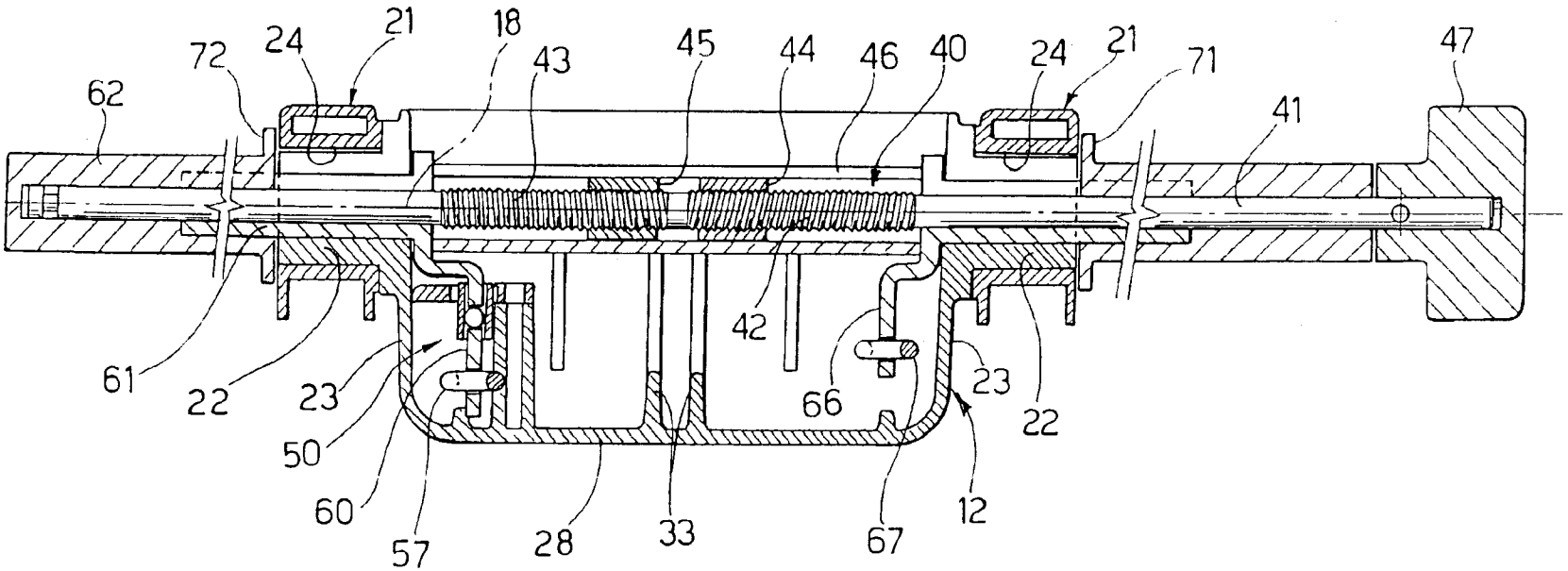

FIG. 8 shows the articulation of the longitudinal elements 21 to the base structure 12. The base structure is preferably provided with two coaxial cylindrical appendages 22 which extend outwards starting from respective lateral walls 23 of the base structure 12. The cylindrical appendages 22 have a common transverse axis which defines the axis of articulation 18 around which the longitudinal elements 21 are articulated. Each of said longitudinal elements 21 has a through hole 24 which receives a respective cylindrical appendage 22. Each longitudinal element 21 is thus articulated to the base 12 around the axis 18 by means of the rotational contact between the outer cylindrical surfaces of the lateral appendages 22 and of the holes 24. The fastening of the longitudinal elements 21 with respect to the base structure 12, in the direction of the transverse axis 18, is obtained in the manner described below.

Figure 9:
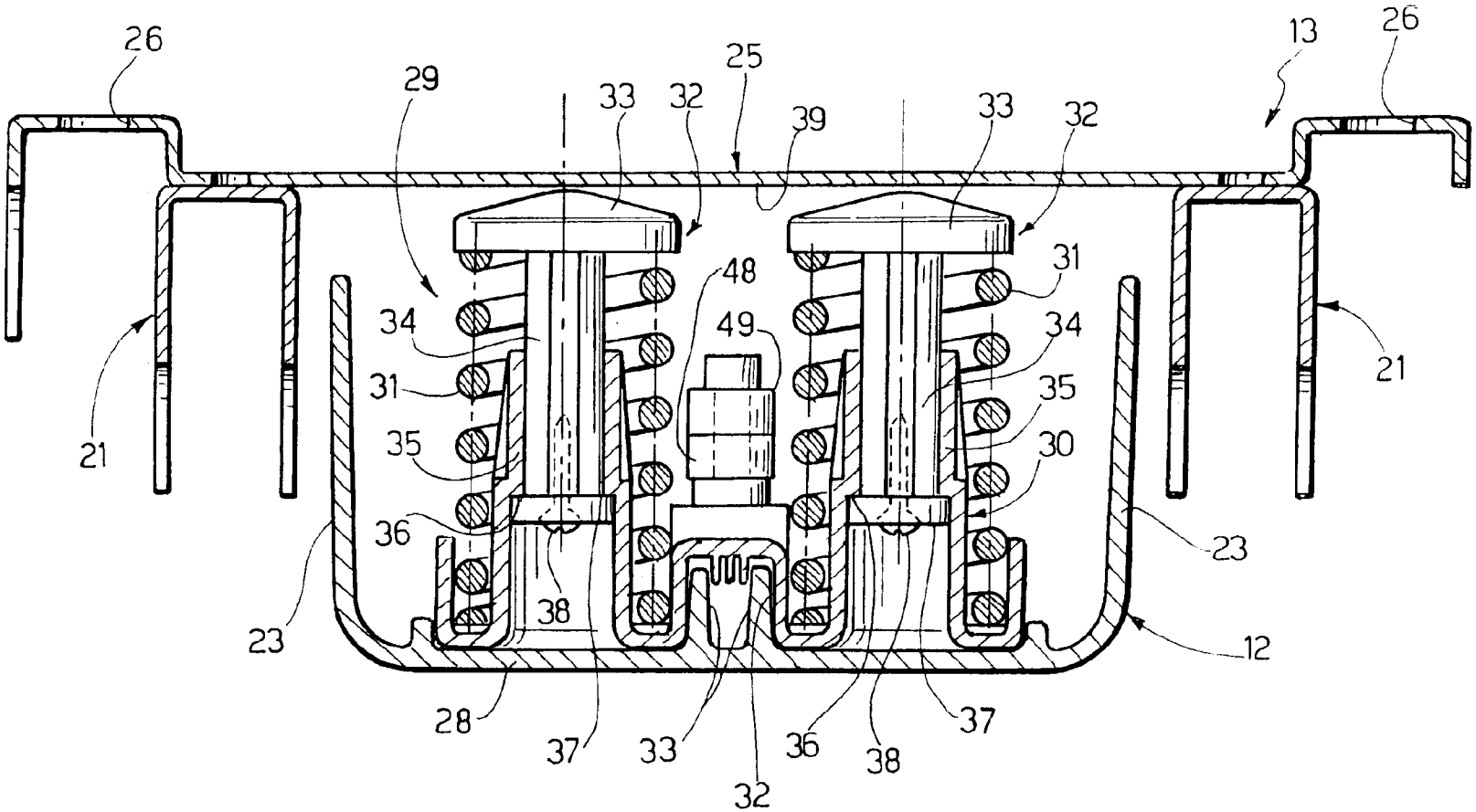

With reference to FIGS. 5 through 10, the base structure 12 bears a support and adjustment mechanism which applies and elastic force between the base structure 12 and the seat support structure. With reference in particular to FIG. 9, the seat support structure 13 comprises a metallic plate 25 fastened to the longitudinal elements 21. The metallic plate 25 is provided with holes 26 for fastening the seat 14.

Figure 7:
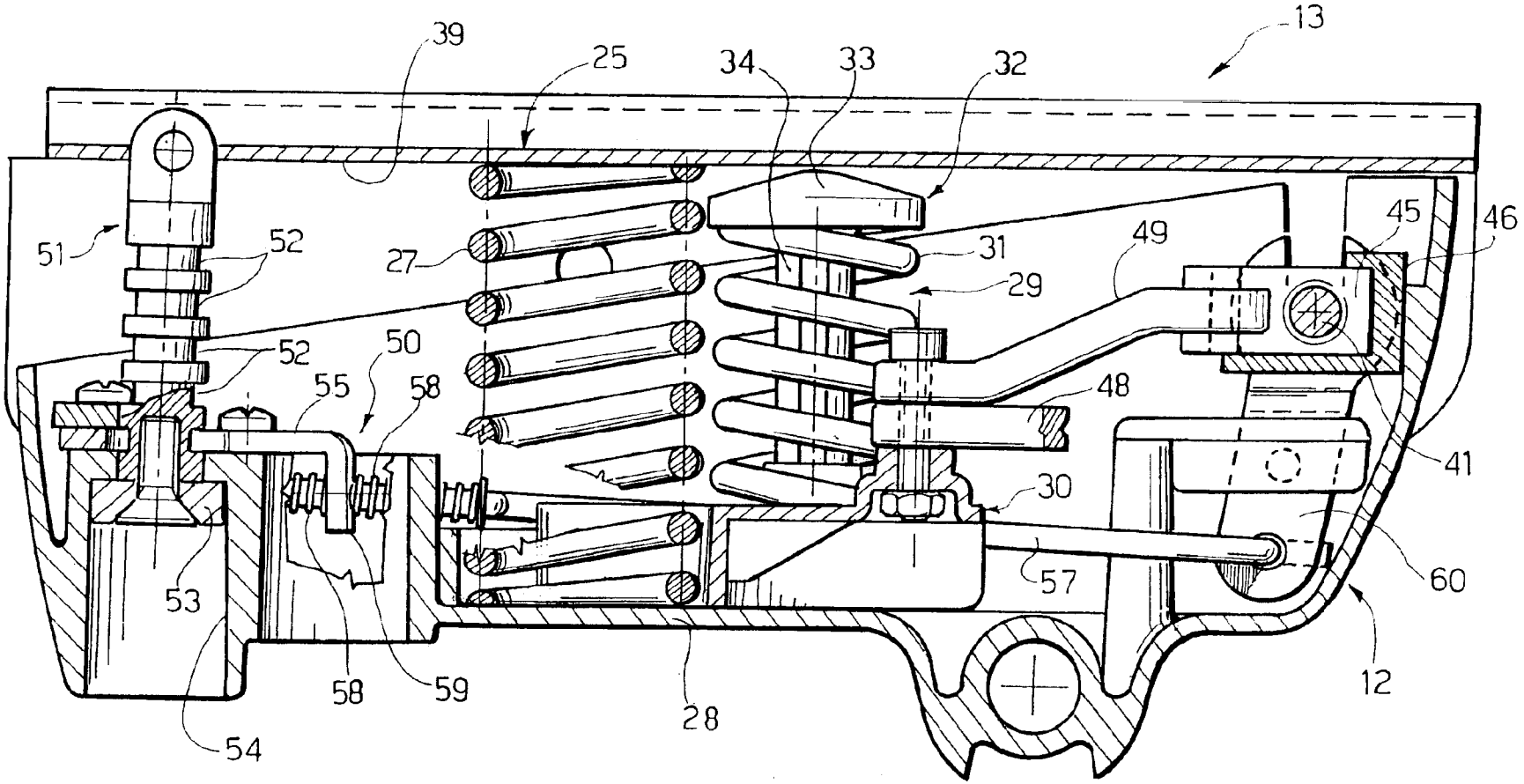
Figure 10:
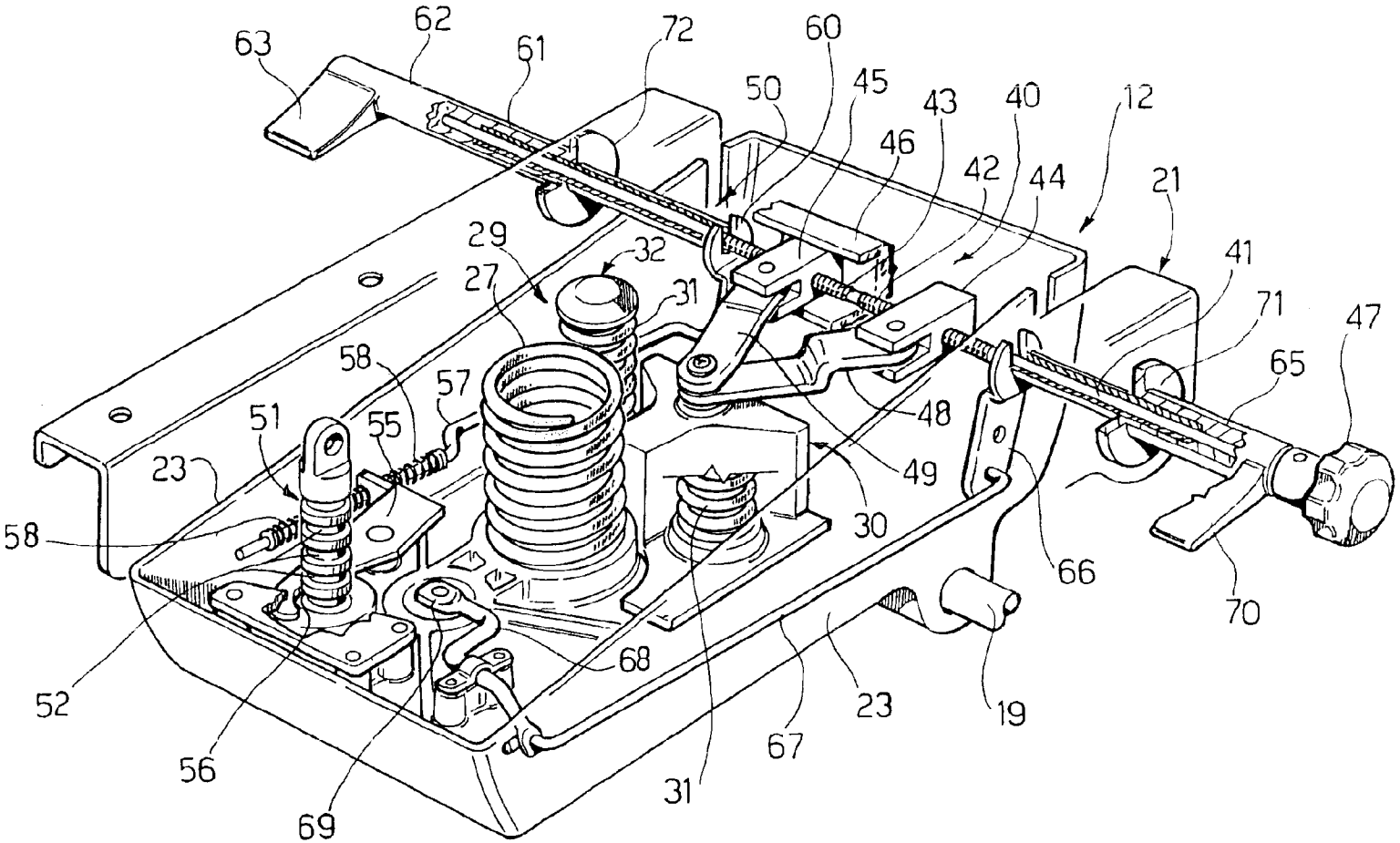
FIG. 10 is a perspective view of the support and adjustment device of the chair according to the present invention.

With reference to FIGS. 5, 7 and 10, the base structure 12 bears a stationary spring 27 which applies an elastic force to the metallic plate 25 biasing the seat 14 towards a resting position. The resting position of the chair is the position assumed by the chair when the user is not seated on the chair or when the user, though seated on the chair, does not oscillate backwards the seat and the backrest. The stationary spring 27 is preferably constituted by a helical spring positioned in compression between the plate 25 and the bottom wall 28 of the base structure 12. The spring 27 is positioned in such a way as to have a certain pre-load in the resting position of the seat. The spring 27 is in a stationary position relative to the base structure 12 and its pre-load is not adjustable. This spring is provided to apply a minimum amount of elastic force to the seat support structure 13.

The chair according to the present invention comprises an adjustable elastic device 29 to apply to the seat support structure 13 an additional elastic force which is summed to the elastic force produced by the stationary spring 27. With reference to FIGS. 5, 7, 9 and 10, the adjustable elastic device 29 comprises a support 30, movable relative to the base structure 12 along a longitudinal direction. As shown in FIG. 9, the support 30 is preferably provided with a groove 32 which slidably engages a pair of longitudinal guide ribs 33 projecting from the bottom wall 28 of the support structure 12.

The adjustable elastic device 29 bears one or more compression springs. In the embodiment shown in the figures, the adjustable elastic device 29 comprises two helical springs 31 in compression positioned parallel to each other. The number and the shape of the springs 31 may naturally vary. Each spring 31 is associated to a respective member 32 for applying the load. Each member 32 for applying the load has a head 33 and a stem 34 which extends coaxially inside the respective spring 31. As shown in particular in FIG. 9, the support 30 has two tubular projections 35 which extend in the vertical direction and which form guides for the stems 34 of the members 32 for applying the load. Each tubular projection 35 has an inner arresting surface 36. The stem 34 of each member 32 for applying the load has an arresting washer 37 fastened to the stem 34 by means of a screw 38. Each spring 31 thrusts upwards the respective member 32 for applying the load. FIG. 9 shows the position of maximum upwards extension of the members 32 for applying the load. This position is defined by the arrest position of the washers 37 against the respective arresting surfaces 36. FIGS. 7 and 9 show the seat support structure 13 in the resting position. The seat is inclined backwards relative to the resting position with an oscillation around its axis of articulation 18 when the user shifts his/her weight backwards pressing against the backrest.

In the resting position of the seat, the spring 27 applies an elastic force to the seat whilst the adjustable elastic device 29 does not apply any force to the seat. As shown in FIGS. 7 and 9, in the resting position of the seat the heads 33 of the members 32 for applying the load do not touch the lower surface 39 of the plate 25 (included in the seat support structure 13). As illustrated in FIGS. 7 and 9, the distance between the lower surface 39 and the upper end of the members 32 for applying the load is very small. After a minimal backwards inclination of the seat, the members 32 for applying the load come in contact with the seat support structure and, at that point, they apply to the seat an elastic force which is summed to the force produced by the stationary spring 27.

The adjustable elastic device 29 is movable in a longitudinal direction with respect to the base structure 12 to vary the elastic reaction torque applied to the seat support structure 13. The longitudinal displacement of the adjustable elastic device 39 varies the arm of the elastic force produced by the springs 31 with respect to the axis of articulation 18 of the seat support structure 13. The variation in the arm of the force allows to adjust the reaction torque opposing the rearward oscillation motion of the seat and of the backrest. It is important to note that throughout the longitudinal range of motion of the adjustable elastic device 29 there is no contact between the seat support structure and the adjustable elastic device 29 when the seat is in the resting position. Therefore, the user can adjust the reaction torque without having to overcome the pre-load force of the spring. In this way, the user can adjust the elastic reaction force of the chair with a very small, constant actuation force. The adjustment must be made with the seat in the resting position so that, during the adjustment operation, the user must avoid leaning backwards against the backrest.

A description is provided below of a preferred embodiment of an adjusting device to command the longitudinal motion of the adjustable elastic device 29. Said device may be replaced by any other device or mechanism able to command the longitudinal displacement of the support 30.

With reference to FIGS. 5, 7, 8 and 10, the support structure 12 bears an adjustment device 40 comprising a transverse rod 41, coaxial with respect to the axis of articulation 18 and borne by the base structure 12 freely sliding around its own longitudinal axis. The central part of the rod 41 extends in the transverse direction inside the base structure 12 and, in this central segment, it has two threaded segments 42, 43 with mutually opposite threads. The threaded segments 42, 43 engage respective threaded holes formed in two shoes 44, 45 mounted slidably in the transverse direction in a guiding element 46, fixed relative to the base structure 12. The guide element 46 has a C shaped sliding seat which prevents the rotation of the shoes 44, 45.

An end of the rod 41 is fastened to an operating knob 47, which can be operated in rotation by the user to command the adjustment motion.

The adjustment device 40 comprises a pair of rods 48, 49, each of which has a first end articulated to a respective shoe 44, 45 and a second end articulated to the longitudinally movable support 30 of the adjustable elastic device 29. The rotation of the rod 41 around the axis 18, commanded by the user by means of the knob 47, causes the shoes 45, 46 to move closer or farther away in relation to each other. The motion of the shoes 45, 46 towards or away from each other causes a longitudinal motion of the support 30 towards the rear part or towards the front part of the chair.

As stated previously, during the adjustment motion the elastic device 29 is unloaded so the user applies a very small torque to the knob 47, sufficient to overcome the friction of the adjustment mechanism 40.

The chair 10 is also provided with a device 50 for locking the chair and the backrest in a series of inclined positions, selectable by the user.

With reference to FIGS. 5, 7, 8 and 10, the device 50 comprises an arresting pivot 51 having an upper end that is articulated or fastened to the plate 25 of the seat support structure 13. The arresting pivot 51 has a plurality of annular grooves 52 and bears at its lower end an arresting element 53 able to slide in the vertical direction in a guiding hole 54 of the base structure 12 (FIG. 7). The position in which the arresting element 54 comes to abut against the upper end of the hole 54 corresponds to the resting position of the seat (FIG. 7).

The locking device 50 comprises a locking lever 55 articulated to the base structure 12 around a vertical axis.

The locking lever 55 is movable between an unlocking position and a locking position. The lever 55 has a hook-shaped end 56 which, in the locked position, is destined to engage one of the annular grooves 52 of the arresting pivot 51. The locking lever 55 is associated to a longitudinal transmission rod 57. The longitudinal transmission rod 57 bears two springs 58 which act on an appendage 59 of the locking lever 55. The front end of the longitudinal transmission rod 57 is articulated to a lever 60 fastened to the end of a tubular sleeve 61 positioned in coaxial fashion externally to the transverse rod 41. The tubular sleeve 61 is fastened to a second sleeve 61 bearing an operating lever 63 which can be moved manually by the operator between a locked position and an unlocked position. The rotation of the sleeves 61, 62 around the axis 18 causes a longitudinal motion of the transmission rod 57. In turn, the transmission rod 57, by means of the springs 58, thrusts the lever 55 towards the locked or towards the unlocked position. When the lever 55 is thrust towards the locked position, if one of the annular grooves 52 of the arresting pivot 51 is exactly at the hook shaped end 56 of the levers 55, the lever 55 immediately moves towards the locked position. If instead the hook shaped end 56 of the lever 55 does not meet an annular groove 52, it is elastically thrust by the spring 58 towards the locked position and it will be engaged in a groove 52 as soon as the user changes the angular position of the seat. When the lever 55 engages an annular groove 52, the seat and the backrest are locked in the selected angular position. The locking and the unlocking of the seat are commanded with an oscillation of the lever 63.

With reference to FIGS. 5 and 10, the chair 10 is further provided with a device 64 to adjust the vertical position of the base structure 12. Said device comprises a tubular sleeve 65 coaxial to the transverse rod 41 and fastened to an operating lever 66. The lever 66 is articulated to a second longitudinal transmission axis 67 which actuates a command lever 68 having a portion 69 that acts on the upper end of a gas spring (not shown) that actuates the vertical displacement of the base structure 12. The tubular sleeve 65 is provided with an actuating portion which, can be operated manually by the user.

The tubular sleeves 65 and 62 positioned at the opposite ends of the transverse rod 41 are provided with respective disk-shaped bearing portions 71, 72 which transversely fasten the longitudinal elements 21. The tubular sleeve 62 is fastened in the axial direction to the rod 41 by means of a pin or elastic ring 73 (FIG. 5). The actuating knob 47 is integral in rotation with the transverse rod 41 through a pin 74.

The commands 47, 70 and 63 are all positioned in the front part of the base structure 12, in a position that is easily accessible by the user when (s)he is seated on the chair (see FIGS. 1 and 2).

Figure 11:
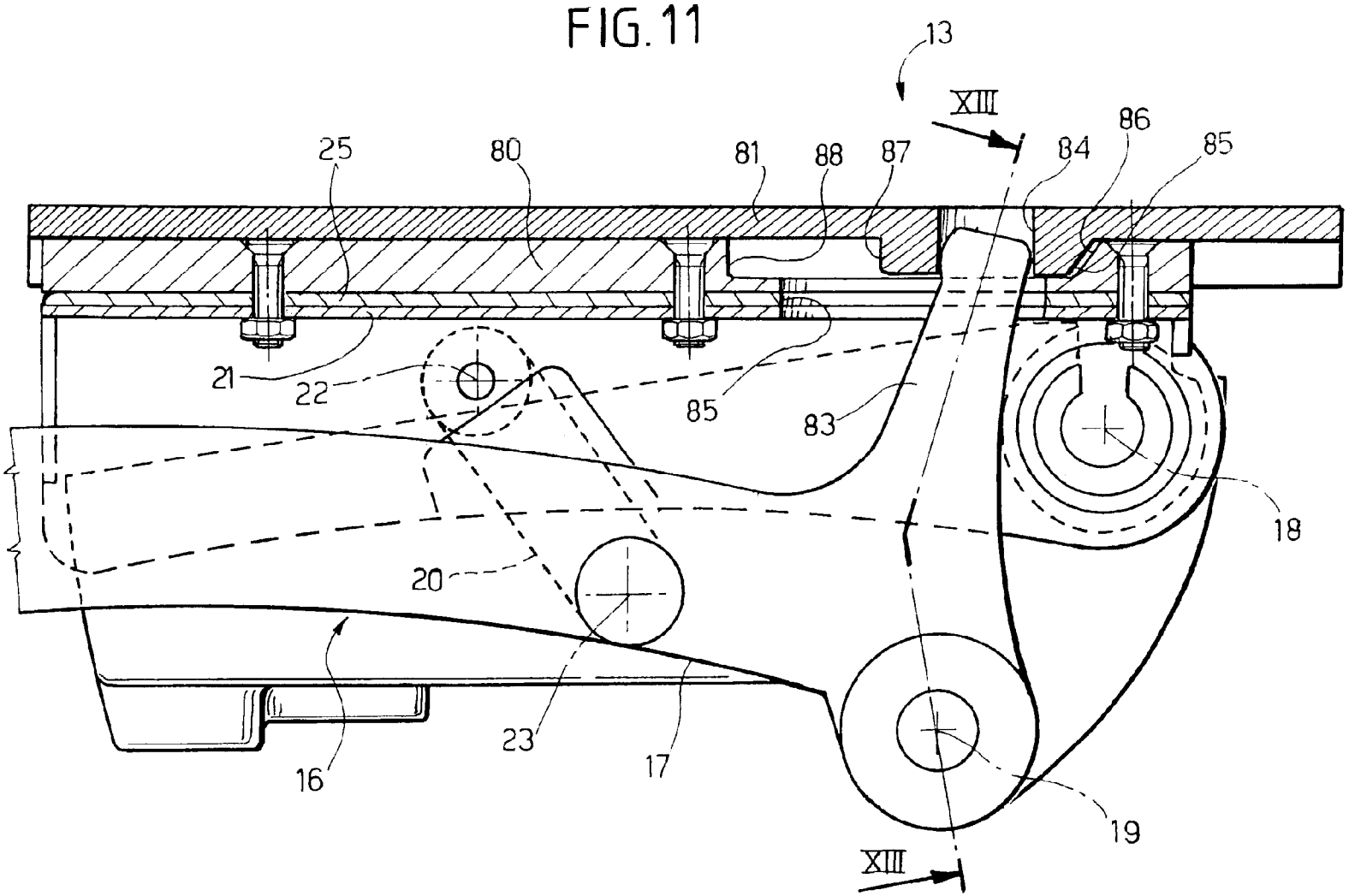
FIG. 11 is a longitudinal section of a variant of the chair according to the invention in resting position.
Figure 12:
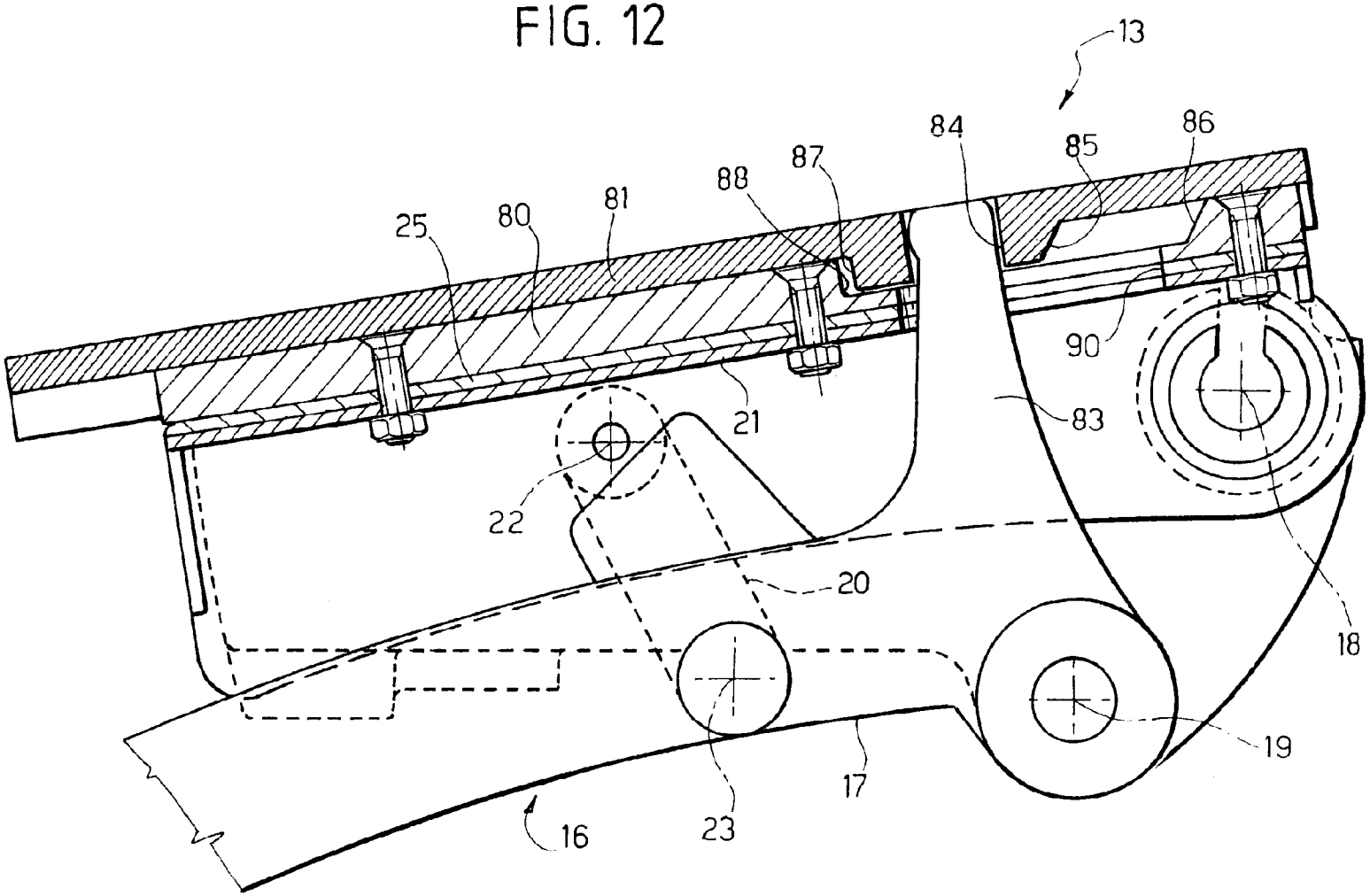
FIG. 12 is a longitudinal section of the variant of FIG. 11 in a rearwards inclined position.
Figure 13:
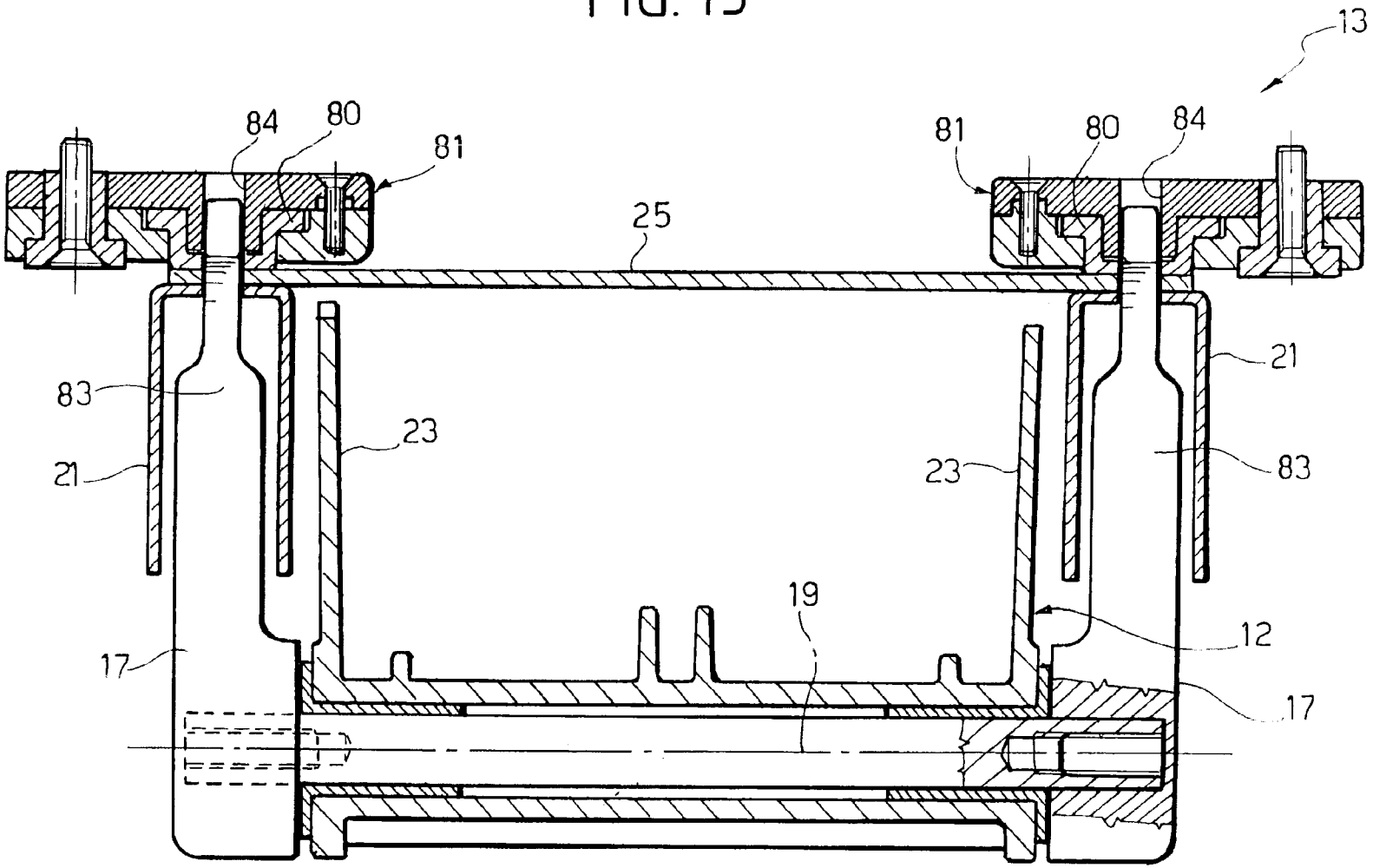
FIG. 13 is a section according to the line XIII—XIII of FIG. 11.

A variant of the present invention is illustrated in FIGS. 11 to 13. In this variant, the seat 14 is movable in the longitudinal direction relative to the support structure of the seat 13. The longitudinal motion of the seat 14 relative to the seat support structure 13 is synchronised to the oscillating motion of the backrest support structure 17 and of the seat support structure 13 around their respective axes 19, 18.

With reference to FIGS. 11–13, the seat support structure 13 comprises, as in the version described previously, a pair of U-shaped longitudinal elements 21 and a metallic plate 25 fastened to the longitudinal elements 21. Two longitudinal guide elements 80 are fastened to the plate 25. Each of the guide elements 80 is slidably engaged by a respective longitudinal shoe 81. The shoes 81 are fastened to the chair 14 (not shown in FIGS. 11–13).

Each of the two arms 17 of the backrest support structure 16 has an appendage 83 which engages a seat 84 formed in the respective shoe 81. The appendage 83 extends with play through a respective longitudinal groove 90 formed in the U-shaped longitudinal element 24, in the plate 25 and in the guide element 80.

As shown in FIGS. 11 and 12, each shoe 81 and the respective guide element 80 have respective mutually co-operating end stop surfaces 85, 86 and 87, 88.

Comparing FIGS. 11 and 12, it is readily apparent that the backwards oscillation of the backrest support structure 16 causes a longitudinal backwards motion of the shoes 81 (fastened to the seat 15) relative to the seat support structure 13.

What is claimed is:

1. A chair, in particular an office chair, comprising:

a base structure, a seat support structure, articulated to the base structure around a transverse axis, an adjustable elastic device to apply an elastic force between the base structure and the seat support structure, an adjustment device which can be operated manually to vary a distance between said adjustable elastic device and said transverse axis, wherein, in a resting position of the seat, said adjustable elastic device does not apply force to the seat support structure, so that the operation of the said adjustment device in said resting position of the seat is carried out without any elastic reaction force acting on the adjustable elastic device, and wherein the adjustable elastic device comprises a support, movable relative to the base structure along a longitudinal direction and bearing at least an elastic element associated with at least a member for applying a load.

2. A chair as claimed in claim 1, comprising a stationary elastic device to apply an elastic force between the base structure and the seat support structure, biasing the seat support structure towards said resting position.

3. A chair as claimed in claim 1, wherein said resting position of the seat said member for applying the load is not in contact with the seat support structure.

4. A chair as claimed in claim 3, wherein the manually operated adjustment device comprises a transverse rod rotatable relative to the base structure around a transverse axis and associated with a transmission mechanism to actuate the translation of said support in the longitudinal direction as a function of the rotation of said rod.

5. A chair as claimed in claim 4, wherein said rod extends coaxially to the axis of articulation between the base structure and the seat support structure.

6. A chair as claimed in claim 1, comprising a backrest support structure articulated to the base structure around a second transverse axis parallel to the axis of articulation between the seat support structure and the base structure.

7. A chair as claimed in claim 6, comprising at least one connecting rod with its ends articulated respectively to the seat support structure and to the backrest support structure, so that oscillating motions of the seat support structure and of the backrest support structure about the respective axes are mutually synchronized.

8. A chair as claimed in claim 1, comprising a locking device to lock the seat in a position selected by a user.

9. A chair as claimed in claim 8, wherein said locking device comprises a locking pivot borne by the seat support structure and movable in a vertical direction relative to the base structure, the locking device comprising a locking lever destined to co-operate with a plurality of annular grooves formed on said locking pivot.

10. A chair as claimed in claim 9, wherein said locking lever is connected to a longitudinal transmission rod movable in longitudinal direction between a locking position and an unlocking position and associated with a rotatable actuation sleeve, operated manually by the user.

11. A chair as claimed in claim 1, comprising a device for adjusting a height of the base structure, which includes a rotatable sleeve associated to a longitudinal transmission rod co-operating with a command member of a gas spring.

12. A chair as claimed in claim 1, comprising a seat movable in the longitudinal direction relative to the seat support structure.

13. A chair as claimed in claim 12, wherein longitudinal motion of the seat is synchronized with oscillating motion of the seat support structure around said transverse axis.

14. A chair, in particular an office chair, comprising:

a base structure, a seat support structure, articulated to the base structure around a transverse axis, an adjustable elastic device to apply an elastic force between the base structure and the seat support structure, an adjustment device which can be operated manually to vary a distance between said adjustable elastic device and said transverse axis, a seat movable in the longitudinal direction relative to the seat support structure, wherein the longitudinal motion of the seat is synchronized with the oscillating motion of the seat support structure around said transverse axis, and wherein the chair further comprises a backrest support structure including a pair of arms provided with respective appendages which engage respective longitudinal shoes fastened to the seat and movable in the longitudinal direction relative to the seat support structure.

* * * * *